US006154113A

United States Patent [19]

Murai

[11] Patent Number: 6,154,113

[45] Date of Patent: Nov. 28, 2000

[54] TRANSFORMER AND METHOD OF ASSEMBLING SAME

[75] Inventor: Hisayoshi Murai, Shizuoka, Japan

[73] Assignee: Koito Manufacturing Co., Ltd., Tokyo, Japan

[21] Appl. No.: 09/337,132

[22] Filed: Jun. 21, 1999

[30] Foreign Application Priority Data

Jun. 22, 1998 [JP] Japan ..... 10-174509

[51] Int. Cl.[7] ..... H01F 27/30

[52] U.S. Cl. ..... 336/198; 336/192; 336/208

[58] Field of Search ..... 336/192, 198, 336/208

[56] References Cited

U.S. PATENT DOCUMENTS 4,857,878 8/1989 Eng, Jr. et al. ..... 336/192
4,916,424 4/1990 Kijima ..... 336/160
5,015,984 5/1991 Vialaneix ..... 336/197
5,534,839 7/1996 Mackin et al. ..... 336/192
5,673,013 9/1997 Moody et al. ..... 336/192

*Primary Examiner*—Michael L. Gellner
*Assistant Examiner*—Anh Mai
*Attorney, Agent, or Firm*—Morgan, Lewis & Bockius LLP

[57] ABSTRACT

A transformer is accommodated in a case body having reduced size. The transformer includes a primary bobbin, a primary coil wound around the primary bobbin, a secondary bobbin combined with the primary bobbin such that the primary coil surrounds the secondary bobbin, and a secondary coil wound around the secondary bobbin. Primary and secondary terminals are respectively connected to the primary and secondary coils such that the primary terminal projects in the same direction as the secondary terminal.

18 Claims, 6 Drawing Sheets

TRANSFORMER AND METHOD OF ASSEMBLING SAME

This application claims the benefit of Japanese Application No. Hei. 10-174509, filed in Japan on Jun. 22, 1998, which is hereby incorporated by reference.

BACKGROUND OF THE INVENTION

1. Field of the Invention

The present invention relates to a transformer and, more particularly, to a transformer accommodated in a case body of reduced size.

2. Discussion of the Related Art

High voltage spark lamps, such as metal halide lamps, have been employed as light source lamps for motor vehicles. The starters of these lamps incorporate transformers to provide an electrical power supply. FIGS. 6 and 7 show an example of a conventional transformer.

As shown in FIG. 6, a transformer 60 comprises a primary bobbin 62, a secondary bobbin 64, and cores 65. A primary coil 61 is wound around the primary bobbin 62, and a secondary coil 63 is wound around the secondary bobbin 64. Also, cores 65 are fitted into the secondary bobbin 64.

The primary bobbin 62 has a tubular body of nearly rectangular shape with the hollow inside portion serving as an arrangement portion 66 to accommodate the secondary bobbin 64 and the secondary coil 63. The primary coil 61 is wound around the primary bobbin 62 at the center thereof. Both ends of the primary coil 61 respectively constitute primary terminals 67, each projecting downwards as shown in FIG. 6.

The secondary bobbin 64 also has a tubular body of nearly rectangular shape with an axially extending hole 68 to receive the cores 65. Both ends 69 of the secondary bobbin 64 in the axial direction constitute flanges that extend outward. The distance defined by outer edges of the flanges 69 is substantially equivalent to the length of the primary bobbin 62 in the axial direction thereof.

The outer cross-section of each of the flanges 69 is identical in shape to the inner cross-section of the primary bobbin 62. However, the size of the outer cross-section of the flanges 69 is slightly smaller than the size of the inner cross-section of the primary bobbin 62. As shown in FIG. 6, at each lower end of the flanges 69, terminal forming portions 70 are formed in the axial direction of the secondary bobbin 64 but in opposite directions such that they are separate from each other. Secondary terminals 71 are formed at respective terminal forming portions 70 to project in the same direction as the respective terminal forming portions 70. The secondary coil 63 is wound around the secondary bobbin 64 except the flanges 69. Both ends of the secondary coil 63 are connected to the secondary terminal portions 71, respectively.

Referring to FIG. 6, the cores 65 comprise base portions 72 that extend vertically, projecting portions 73 the project from the respective upper ends of the base portions 72 in the direction to reduce the distance therebetween, and inner fitting portions 74 that project from the lower ends of the base portions 72 in the same direction as the respective projecting portions 73. The distance defined by the base portions 72 and the corresponding edges of the projecting portions 73 is equal to the distance defined by the base portions 72 and the corresponding edges of the inner fitting portions 74. Then, the length obtained by adding each length of the projecting portions 73 in the projecting direction is made equivalent to the length of the secondary bobbin 64 in the axial direction. The inner fitting portions 74 are shaped to be received into the fitting hole 68 of the secondary bobbin 64.

The assembly of the conventional transformer 60 will now be described.

The secondary bobbin 64 is inserted into the arrangement portion 66 of the primary bobbin 62 in the axial direction until the flanges 69 are positioned corresponding to both ends of the primary bobbin 62. The inner fitting portions 74 of the cores 65 are inserted into the fitting hole 68 from both axial ends of the secondary bobbin 64 that has been inserted into the arrangement portion 66 until one front surface of the inner fitting portion 74 abuts against the other front surface of the corresponding inner fitting portion. Concurrently, both front surfaces of the projecting portions 73 will also abut when the front surfaces of the inner fitting portions 74 abut.

As shown in FIG. 7, a cover 75 is fitted with the above-described transformer 60 to enclose the primary bobbin 62 and the secondary bobbin 64. When cover 75 is fitted with the transformer 60, the primary terminals 67 formed at both ends of the primary coil 61 project in the same direction through insertion holes formed in the cover 75. The secondary terminals 71 of the secondary bobbin 64 also project from the cover 75 outwards in the direction perpendicular to the projecting direction of the primary terminals 67.

The transformer 60 having the cover 75 is then accommodated in a case body 76 having an opening at one side such that the respective terminals 67, 71 are connected to the corresponding contacts (not shown) or corresponding contacts for connection to a discharge lamp (not shown) in a ballast 77 also accommodated in the case body 76. The opening of the case body 76 is covered with a lid (not shown) to seal the case body 76.

The transformer 60 is accommodated in the case body to face the ballast 77 accommodated in the case body 76 such that the secondary terminals 71 extend in the direction X—X and the primary terminals 67 extend in the direction Y—Y (perpendicular to the X—X direction) as shown in FIG. 7.

In the aforementioned conventional transformer 60, the secondary terminals 71 of the secondary bobbin 64 project in the same direction as the axial direction of the secondary bobbin 64. That is, the secondary terminals 71 project in the X—X direction which is perpendicular to the projecting direction of the primary terminals 67 as shown in FIG. 7. This structure keeps the secondary terminals 71 from being in contact with the primary bobbin 62 when inserting the secondary bobbin 64 into the arrangement portion 66 of the primary bobbin 62.

Therefore, the length of the case body 76 in the X—X direction must be large enough to accommodate the projecting secondary terminals 71. Also, the length of the case body 76 in the Y—Y direction must be large enough to accommodate the projecting primary terminals 67. As a result, the size of the case body 76 is enlarged.

SUMMARY OF THE INVENTION

Accordingly, the present invention is directed to a transformer that substantially obviates one or more of the problems due to limitations and disadvantages of the related art.

An object of the present invention to overcome the foregoing problems and to provide a transformer which permits the size of the corresponding case body to be reduced.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a transformer to be accommodated in a case body of reduced size includes a primary bobbin; a primary coil wound around the primary bobbin; a primary terminal connected to the primary coil; a secondary bobbin combined with the primary bobbin such that the primary coil surrounds the secondary bobbin; a secondary coil wound around the secondary bobbin; and a secondary terminal connected to the secondary coil, wherein the primary terminal projects in the same direction as the secondary terminal.

In another aspect, a method of assembling a transformer includes the steps of winding a secondary coil around a secondary bobbin; connecting at least one secondary terminal to the secondary coil; inserting the secondary bobbin with the secondary coil into a primary bobbin through an opening defined on a side of a primary bobbin, the opening being defined on a side perpendicular to an axis of the secondary bobbin; winding a primary coil around a primary bobbin such that the primary coil surrounds the secondary bobbin; and connecting at least one primary terminal to the primary coil, wherein the primary terminal projects in the same direction as the secondary terminal.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

The embodiment of the transformer of the present invention described below is applied to a transformer incorporated into a starter for a discharge lamp. The discharge lamp may serve as a light source lamp in motor vehicle. Of course, the transformer may be incorporated into other devices, or the discharge lamp may be used in non-motor vehicle applications.

Figure 1:
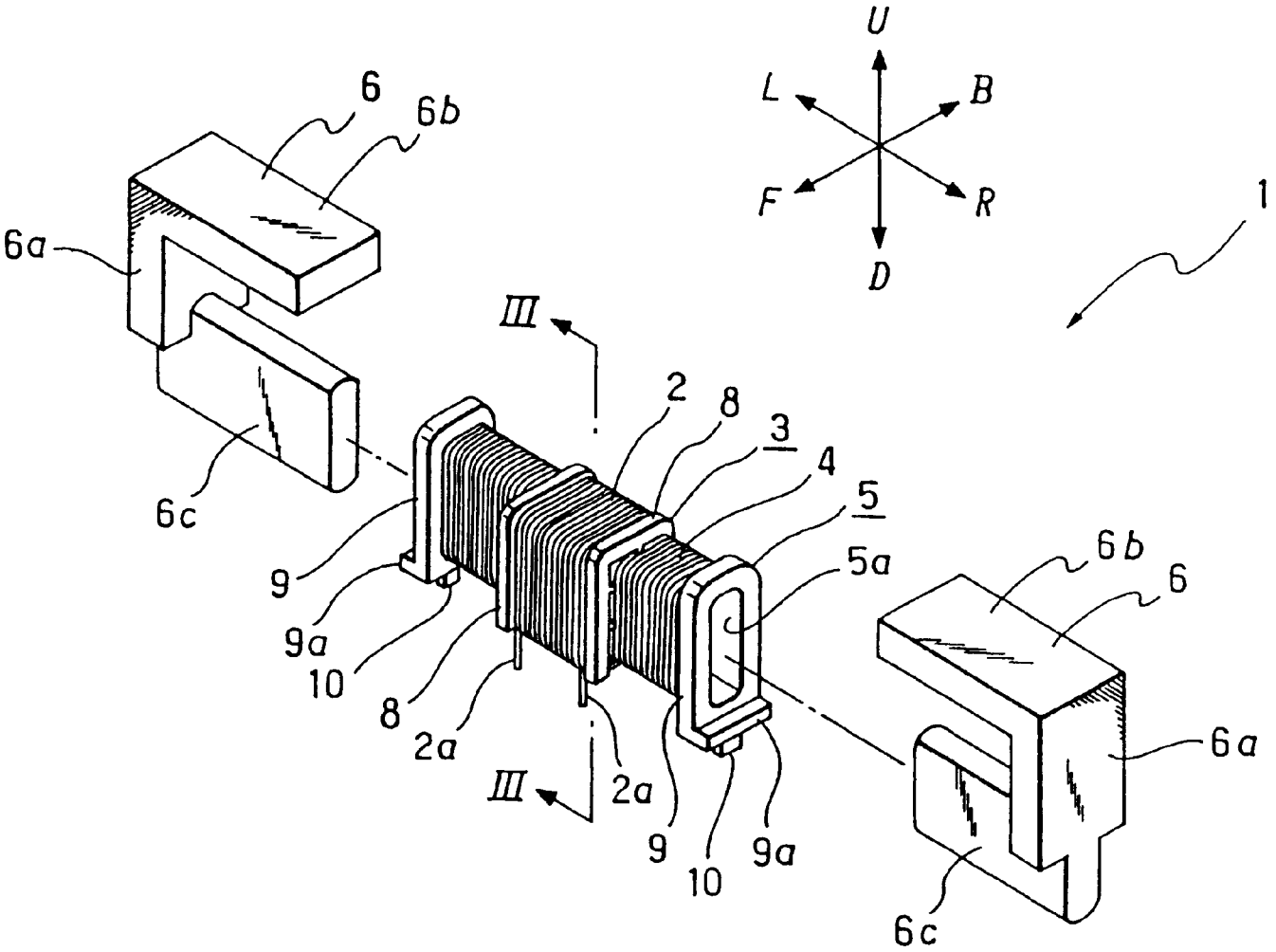
FIG. 1 is an exploded perspective view of one embodiment of a portion of a transformer according to the present invention.

It is assumed that the directions mentioned herein will be defined as indicated in FIG. 1. That is, the forward direction is indicated by arrow F, the backward direction is indicated by arrow B, the upward direction is indicated by arrow U, the downward direction is indicated by arrow D, the right direction is indicated by arrow R, and the left direction is indicated by arrow L.

Figure 3:
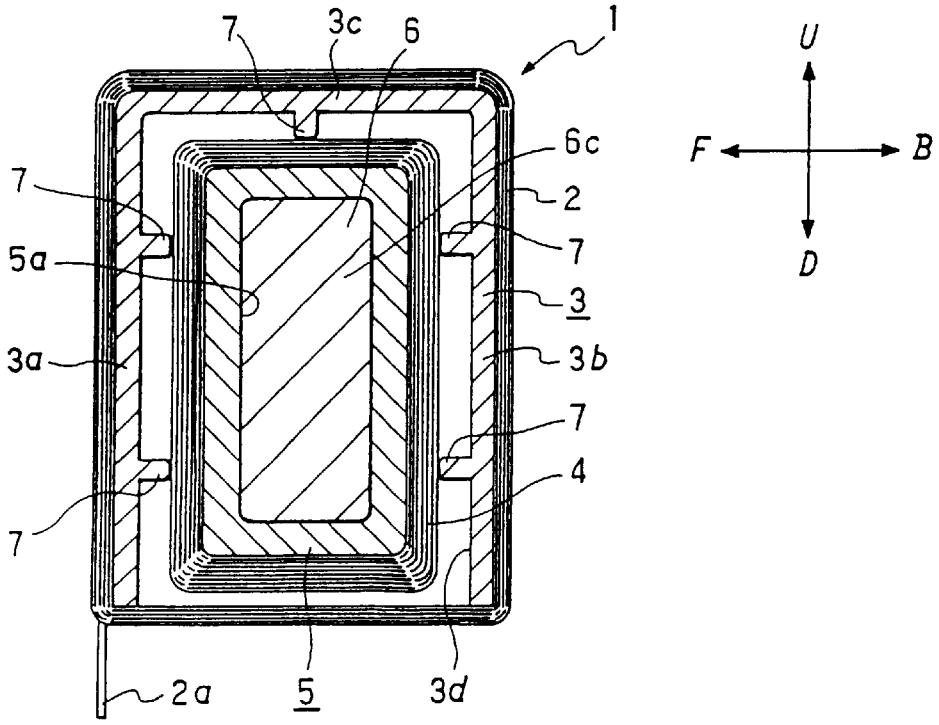
FIG. 3 is an enlarged sectional view of the transformer taken along line III—III of FIG. 1.
Figure 4:
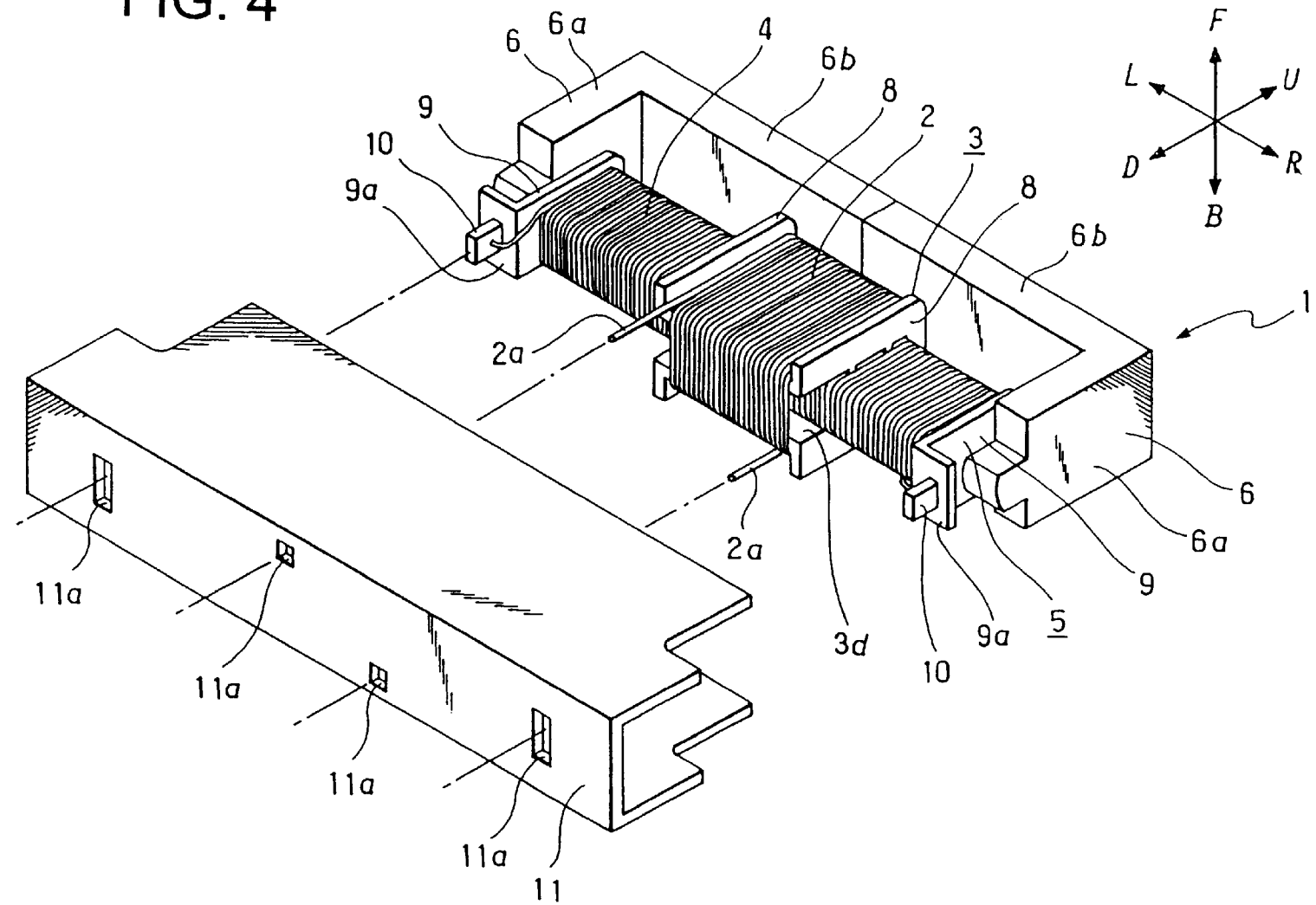
FIG. 4 is an enlarged perspective view of the transformer of FIG. 1 and the cover fitted therewith.
Figure 5:
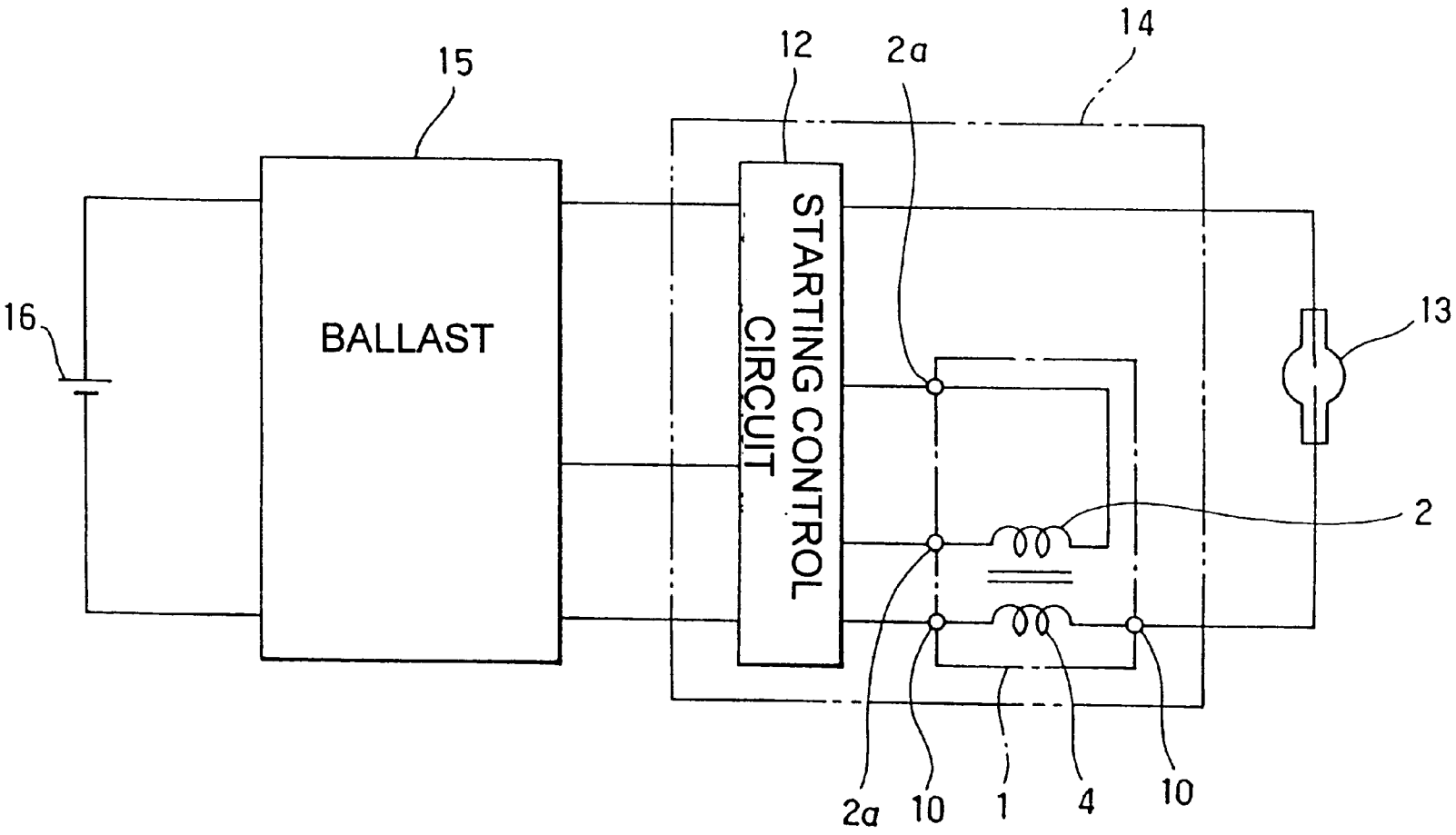
FIG. 5 is a circuit diagram representing the starter and the ballast corresponding to the transformer of FIG. 1.

Referring to FIGS. 1, 3, and 4, a transformer I comprises a primary bobbin 3, secondary bobbin 5, and ferrite cores 6. A primary coil 2 is wound around the primary bobbin 3, and a secondary coil 4 is wound around the ferrite cores 6 each fitted to the secondary bobbin 5.

Figure 2:
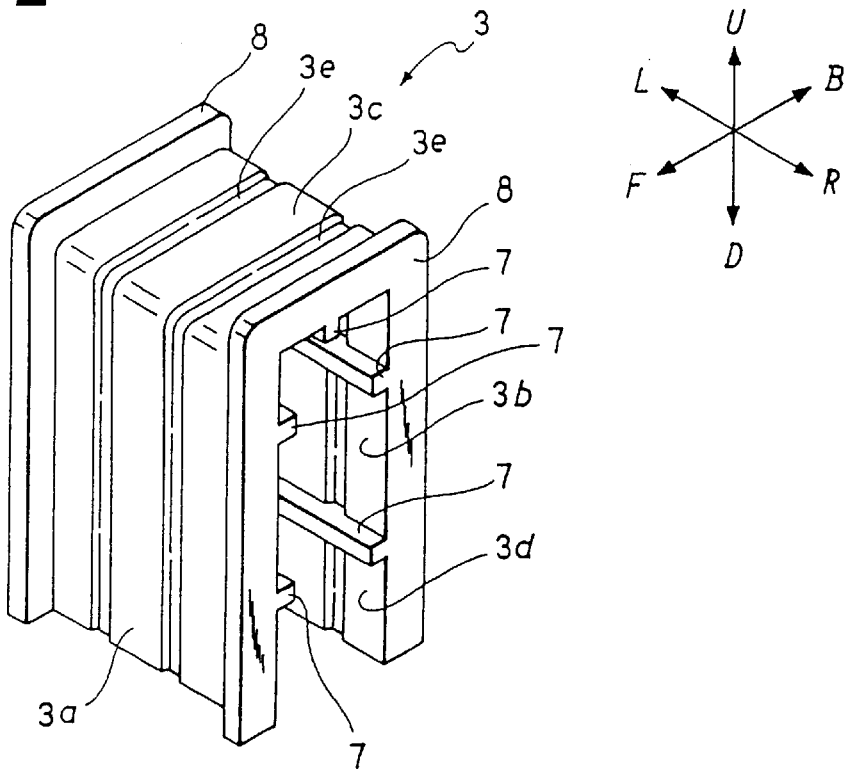
FIG. 2 is an enlarged perspective view of the primary bobbin of the transformer of FIG. 1.

The primary bobbin 3 is formed of a suitable material such as synthetic resin material exhibiting high elasticity. Further, the primary bobbin 3 has a substantially U-shaped configuration where the lower portion is opened as viewed from the longitudinal direction. Specifically, the primary bobbin 3 is defined by a front wall 3*a,* a back wall 3*b,* and an upper wall 3*c* for connecting the respective upper edges of the front and back walls 3*a,* 3*b* as shown in FIG. 2. The front wall 3*a* and the back wall 3*c* serve as a grip portion for gripping the secondary bobbin 5 that has been fitted in the primary bobbin 3 will be described herein. The primary bobbin 3 has an insertion portion 3*d* defined by the front wall 3*a,* upper wall 3*c,* and the back wall 3*b* with the lower portion being opened.

The inner surface of the primary bobbin 3 is provided with ribs 7 extending in the longitudinal direction. In the illustrated embodiment, each inner surface of the front wall 3*a* and the back wall 3*b* has two ribs 7 respectively positioned at upper and lower sides. Here, the upper wall 3*c* is also provided with the rib 7 at the center in the lateral direction. Flanges 8 are formed extending outward from the left and the right ends of the primary bobbin 3.

The surface of the primary bobbin 3 has thin wall portions 3*e* formed along the surface thereof which define planes parallel to those defined by the flanges 8. Each of the thin wall portions 3*e* extend from the lower end of the front wall 3*a* to the lower end of the back wall 3*b* via the upper wall 3*c,* and formed at the left and right sides of the primary bobbin 3 at a predetermined spacing.

The primary coil is wound around the surface of the primary bobbin 3 except the flanges 9. Here, the primary coil 4 is wound in a direction substantially parallel to the flanges 9 such that both ends 2*a* of the primary coil 2 form primary terminals projecting downward from the primary bobbin 3, as shown in FIGS. 1, 3, and 4.

The secondary bobbin 5 is preferably formed as a tubular body of nearly rectangular shape with longitudinal length longer than that of the primary bobbin 3. The secondary bobbin 5 has a hole 5*a* extending along its length in the longitudinal direction to receive the cores 6. Flanges each extending outward are formed at the left and the right ends 9 of the secondary bobbin 5.

Terminal forming portions 9*a* that project to the left and the right are formed at the respective lower ends of the flanges 9. Each terminal forming portion 9*a* has a secondary terminal 10 projecting downward from the bottom thereof.

The secondary coil 4 is wound around the surface of the secondary bobbin 5 except the flanges 9. Both ends of the secondary coil 4 are connected to respective ones of the secondary terminals 10. When the secondary coil 4 is wound around the secondary bobbin 5, the outside lateral length defined by the secondary coil 4 is slightly longer than the length defined between the ribs 7 formed on the front wall 3*a* and the ribs 7 formed on the back wall 3*b*. Similarly, the outside vertical length defined by the secondary coil 4 is slightly shorter than the length defined by the inner surface of the upper wall 3*c* of the primary bobbin 3 and the lower end of the front wall 3*a* or the back wall 3*b*.

The cores 6 are defined by vertically extending base portions 6*a*, projecting portions 6*b* projecting from the respective upper end portions of the base portions 6*a* to substantially abut each other, and inner fitting portions 6*c* extending downward from the respective lower end portions of the base portions 6*a* and projecting in the same direction as the projecting portion 6*b*. The length from the upper edge of the base portion 6*a* to the corresponding outer edge of the projecting portions 6*b* is equivalent to the length from the lower edge of the base portions 6*a* to the outer edge of the inner fitting portions 6*c*. The longitudinal length obtained by adding each length of the projecting portions 6*b* is equivalent to the distance defined by the outer ends of the flanges 9 of the secondary bobbin 5. The cross-sectional shape of the inner fitting portions 6*c* is formed to be received into the fitting hole 5*a* of the secondary bobbin 5.

The assembly of the transformer 1 with reference to FIGS. 1–5 will now be described.

First, the secondary coil 4 is wound around the secondary bobbin 5. Then, the secondary bobbin 5 is inserted into the insertion portion 3*d* of the primary bobbin 3 through the lower opening of the primary bobbin 3 so that the primary bobbin 3 is positioned at the center of the secondary bobbin 5 with respect to the longitudinal direction. Here, the primary coil 2 is not yet wound around the primary bobbin 3. As previously described, the primary bobbin 3 may be formed of a synthetic resin material exhibiting high elasticity and the lateral distance defined by the outer ends of the secondary coil 4 is slightly longer than the distance defined between the ribs 7 of the front wall 3*a* of the primary bobbin 3 and the ribs 7 of the back wall 3*b* of the primary bobbin 3. Accordingly, the inside of the primary bobbin 3 is deformed to cause the front wall 3*a* and the back wall 3*b* to be separated from each other while inserting the secondary bobbin 5 into the insertion portion 3*d* of the primary bobbin 3. Because the primary bobbin 3 has the thin wall portions 3*e* formed on the outer surfaces thereof, the primary bobbin 3 is more easily deformed to allow insertion of the secondary bobbin 5 into the insertion portion 3*d* of the primary bobbin 3.

Upon insertion of the secondary bobbin 5 into the insertion portion 3*d* of the primary bobbin 3, the primary bobbin 3 will slightly deform to cause the front wall 3*a* and the back wall 3*b* to be apart from each other. This will bring the secondary coil 4 wound around the secondary bobbin 5 into elastic contact with the ribs 7 respectively formed on the front wall 3*a* and the back wall 3*b*. In this way, the primary bobbin 3 is combined with the secondary bobbin 5 having the secondary coil 4 wound therearound. Insertion of the secondary bobbin 5 is continued until the secondary coil 4 is brought into contact with the rib 7 formed on the upper wall 3*c* of the primary bobbin 3. Next, the secondary coil 2 is wound around the primary bobbin 3.

The inner fitting portions 6*c* of the cores 6 are inserted into the fitting hole 5*a* from the left and the right sides of the secondary bobbin 5 until the front surfaces of the inner fitting portion 6*c* abut each other. Concurrently with the abutment of the respective front surfaces of the inner fitting portions 6*c*, the front surfaces of the projecting portions 6*a* abut each other.

As shown in FIG. 4, the assembled transformer 1 is fitted with a cover 11 having a U-shaped cross-section. The cover 11 may be formed of a resin material and having an open top as viewed along the cross-section. The cover 11 serves to enclose the primary and secondary bobbins 3, 5 such that the primary coil 2 and the secondary coil 4 are insulated from the outside. A plurality of through holes 11*a* are formed in the bottom side of the cover 11 to receive the corresponding terminals 2*a* and 10 of the transformer 1. When the cover 11 is fit onto the transformer 1, the terminals 2*a* and 10 project downward through the corresponding through holes 11*a*.

If desired, a gelled resin (for example, silicon gel) may be injected into the cover 11 for thermosetting, thereby further enhancing the insulation of the primary coil 2 and the secondary coil 4 from the outside.

The transformer 1 fitted with the cover 11 is further accommodated in a case body (not shown) which opens upwards. The primary terminals 2*a* of the transformer 1 accommodated in the case body are connected to the respective contacts of a starting control circuit 12 of FIG. 5 that is disposed in the case body. One of the secondary terminals 10 is connected to the other contact of the starting control circuit 12, and the other secondary terminal 10 is connected to a contact to be connected to the discharge lamp 13 (not shown).

If desired, the case body may be filled with the gelled resin (for example, the silicon gel). By thermosetting the filled resin, the transformer 1 is embedded within the filled resin together with the ballast 15. As described above, the transformer 1 fitted with the cover 11 and accommodated within the case body. Of course, the transformer 1 having no cover 11 fitted therewith can also be accommodated in the case body and embedded within the resin that has been filled therein.

A starter 14 is formed of the transformer 1 and the starting control circuit 12. The starter 14 is connected to the ballast 15 accommodated in the case body, which includes a DC/DC converter, DC/AC converter, control circuits and the like. The ballast 15 is connected to a power supply (for example, a battery) 16. The battery voltage is boosted by the ballast 15 and converted into the alternating voltage that is supplied to the discharge lamp 13. In order to turn the discharge lamp 13 on, the voltage boosted by the ballast 15 is further boosted by the starter 14 and applied to the discharge lamp 13.

In the aforementioned transformer 1, the primary bobbin 3 is U-shaped with an opening at one side. The secondary bobbin 5 is inserted through the opening and combined with the primary bobbin 3. Accordingly, the secondary terminal portions 10 of the secondary bobbin 5 are not required to project in the longitudinal direction. Instead, the terminal portions 10 may project in the same direction (i.e., downward) as the projecting direction of the primary terminals 2*a*.

The primary terminals 2*a* project in a direction that is not perpendicular to the direction that the secondary terminals 10 project. Therefore, the case body for enclosing the transformer 1 only requires the space for accommodating the primary terminals 2*a* and the secondary terminals 10 each projecting in the same direction, thereby reducing the overall size of the case body.

Figure 6:
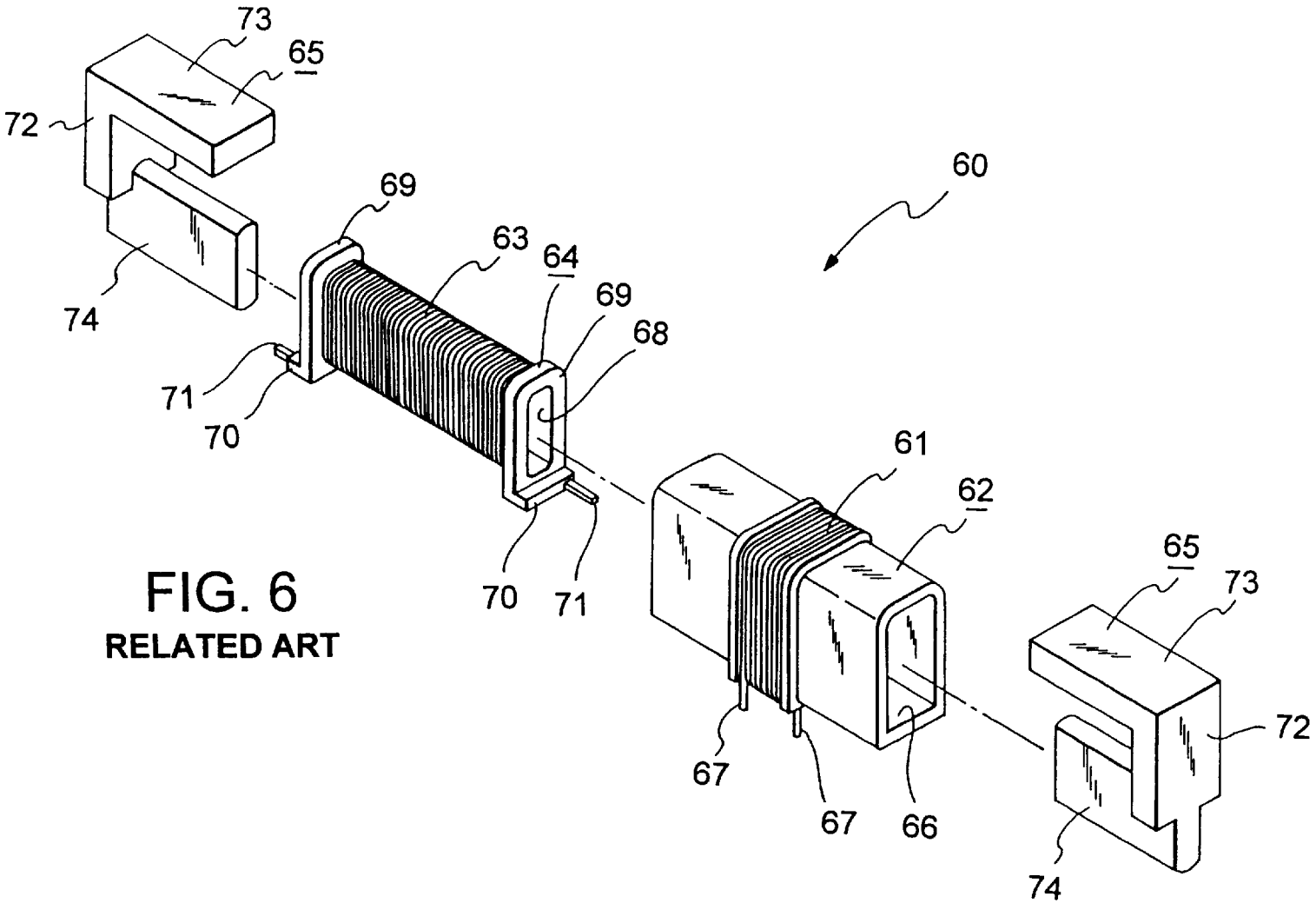
FIG. 6 RELATED ART
FIG. 6 is an exploded perspective view showing a conventional transformer.
Figure 7:
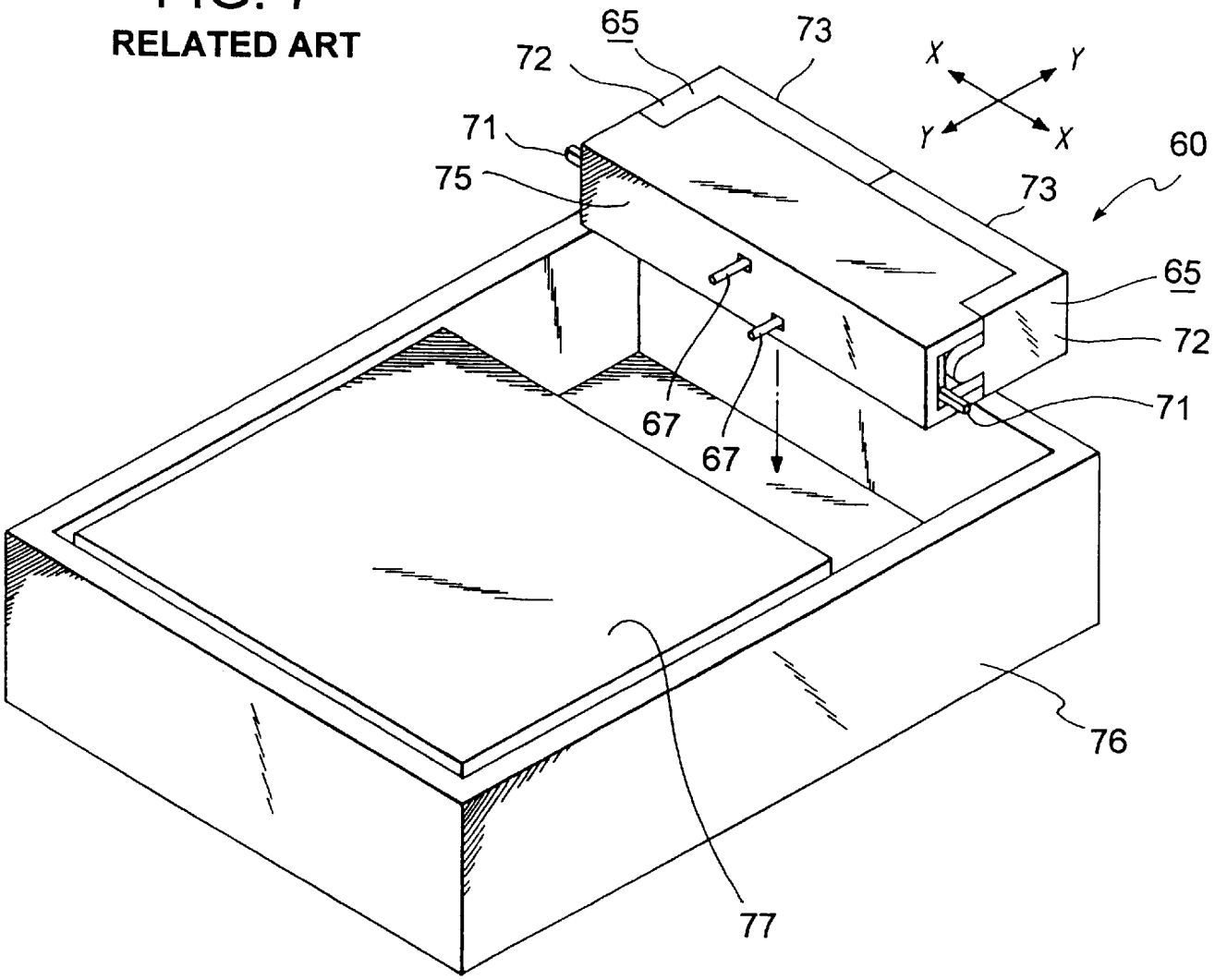
FIG. 7 RELATED ART
FIG. 7 is a perspective view of the conventional transformer of FIG. 6 fitted with a case body.

The primary bobbin 3 can be easily combined with the secondary bobbin 5 by bringing the ribs 7 respectively formed on the front wall 3*a* and the back wall 3*b* into elastic contact with the secondary bobbin 5 using the elasticity of the primary bobbin 3. The conventional transformer of FIGS. 6 and 7 is assembled by bonding the primary and the secondary bobbins using the adhesive. In contrast, the transformer 1 of the present invention is assembled by combining the primary bobbin 3 with the secondary bobbin 5 using the elasticity of the primary bobbin 3, thereby eliminating the need for an adhesive. As a result, the cost for manufacturing the transformer 1 is also reduced.

As would be understood in view of the foregoing description, the transformer of the present invention has a transformer that is accommodated in a case body. The transformer is provided with a primary bobbin, a secondary bobbin and a core. The primary bobbin has a primary coil wound therearound and a primary terminal connected to the primary coil. The secondary bobbin has a secondary coil wound therearound with a secondary terminal connected to the secondary coil. The core is fitted into the secondary bobbin. In the aforementioned transformer, the primary bobbin has an opening to accommodate the secondary bobbin to be combined therewith from a direction perpendicular to the direction where the secondary bobbin extends through the primary coil. Also, the primary terminal projects in the same direction as the secondary terminal.

Therefore, the case body for the transformer is required to only have enough space to accommodate the primary terminals and the secondary terminals that project in the same direction, thereby allowing a reduction in the size of the case body.

According to another aspect of the present invention, because the grip portion is formed in the primary bobbin to grip the secondary bobbin such that the elastic force in the direction in which the secondary bobbin is gripped is urged against the grip portion, thereby allowing easy combination of the primary and the secondary bobbins.

According to yet another aspect of the present invention, the thin wall portion is formed on the primary bobbin extending along the winding direction of the primary coil. The primary bobbin more easily deformed to facilitate the combination of the primary and secondary bobbins.

It will be apparent to those skilled in the art that various modifications and variations can be made in the transformer of the present invention without departing from the spirit or scope of the invention. Thus, it is intended that the present invention cover the modifications and variations of this invention provided they come within the scope of the appended claims and their equivalents.

What is claimed is:

1. A transformer to be accommodated in a case body of reduced size, comprising:

a primary bobbin;

a primary coil wound around the primary bobbin;

a primary terminal connected to the primary coil;

a secondary bobbin combined with the primary bobbin such that the primary coil surrounds the secondary bobbin;

a secondary coil wound around the secondary bobbin; and a secondary terminal connected to the secondary coil, wherein the primary terminal projects in the same direction as the secondary terminal, wherein the primary bobbin has a grip portion for gripping the secondary bobbin, and an elastic force urges against the grip portion toward the direction where the secondary bobbin is gripped.

2. The transformer according to claim 1, wherein the primary and secondary terminals project in a direction perpendicular to a axis of the primary bobbin.

3. The transformer according to claim 1, wherein the primary bobbin defines an opening on a side of the primary bobbin perpendicular to a axis of the primary bobbin to receive the secondary bobbin.

4. The transformer according to claim 3, wherein the primary bobbin is substantially rectangular in cross-sectional shape.

5. The transformer according to claim 4, wherein the primary bobbin defines front, back, and top sides with a bottom corresponding to the opening.

6. The transformer according to claim 3, wherein the primary and secondary terminals project in a direction perpendicular to the axis of the primary bobbin.

7. The transformer according to claim 1, wherein the primary bobbin has at least one thin wall portion formed substantially parallel to a winding direction of the primary coil.

8. The transformer according to claim 1, further comprising a core to be fitted into a hole define along an axis of the secondary bobbin.

9. The transformer according to claim 8, wherein the core includes first and second core portions that are respectively fitted into opposite axial ends of the secondary bobbin.

10. A method of assembling a transformer, comprising the steps of:

winding a secondary coil around a secondary bobbin;

connecting at least one secondary terminal to the secondary coil;

inserting the secondary bobbin with the secondary coil into a primary bobbin through an opening defined on a side of a primary bobbin, the opening being defined on a side perpendicular to an axis of the secondary bobbin;

winding a primary coil around a primary bobbin such that the primary coil surrounds the secondary bobbin; and connecting at least one primary terminal to the primary coil, wherein the primary terminal projects in the same direction as the secondary terminal, wherein the primary bobbin has a grip portion for gripping the secondary bobbin, and an elastic force urges against the grip portion toward the direction where the secondary bobbin is gripped.

11. The method according to claim 10, wherein the primary and secondary terminals are connected to project in a direction perpendicular to the axis of the primary bobbin.

12. The method according to claim 10, wherein the secondary coil is wound around a secondary bobbin having a substantially rectangular cross-sectional shape.

13. The method according to claim 10, wherein the primary coil is wound around a primary bobbin having a substantially rectangular cross-sectional shape.

14. The method according to claim 13, wherein the primary coil is wound around a front side, a back side, a bottom side, and a bottom side of the primary bobbin, the bottom side corresponding to the opening.

15. The method according to claim 13, wherein the primary and secondary terminals are connected to project in a direction perpendicular to the axis of the primary bobbin.

16. The method according to claim 10, wherein the primary bobbin has at least one thin wall portion formed substantially parallel to a winding direction of the primary coil.

17. The method according to claim 10, further comprising a step of fitting a core into a hole defined along an axis of the secondary bobbin.

18. The method according to claim 17, wherein the fitting step includes a step of fitting first and second core portions into respective opposite axial ends of the secondary bobbin.

* * * * *